United States Patent [19]

Mieyal

[11] 4,113,219

[45] Sep. 12, 1978

[54] ADJUSTABLE PEDESTAL FOR ELEVATED FLOORS

[75] Inventor: David F. Mieyal, Strongsville, Ohio

[73] Assignee: Donn Products, Inc., Westlake, Ohio

[21] Appl. No.: 803,078

[22] Filed: Jun. 3, 1977

[51] Int. Cl.[2] ..... E04G 25/00

[52] U.S. Cl. ..... 248/354 R; 254/104

[58] Field of Search ..... 248/188.2, 188.5, 354 R, 248/354 P; 254/11, 42, 104; 52/126, 263

[56] References Cited

U.S. PATENT DOCUMENTS

| | | | |
|---|---|---|---|
| 2,723,100 | 11/1955 | Muschamp et al. | 248/354 R |
| 3,324,614 | 6/1967 | Loewenau | 248/354 R X |

FOREIGN PATENT DOCUMENTS

| | | | |
|---|---|---|---|
| 216,205 | 7/1961 | Austria | 248/354 P |
| 801,536 | 1/1951 | Fed. Rep. of Germany | 248/354 P |
| 584,918 | 11/1958 | Italy | 248/354 P |
| 658,499 | 12/1963 | Italy | 248/354 P |
| 778,624 | 7/1957 | United Kingdom | 248/354 P |
| 1,190,086 | 4/1970 | United Kingdom | 254/104 |

*Primary Examiner*—Lawrence J. Staab
*Attorney, Agent, or Firm*—McNenny, Pearne, Gordon, Gail, Dickinson & Schiller

[57] ABSTRACT

A pedestal assembly for supporting elevated floors having means for adjusting its height in the form of a generally triangular wedge. The wedge is horizontally displaceable on the assembly to cam an upper carrier element of the assembly into a desired elevation. The assembly is provided with self-locking means to maintain the wedge and carrier elements in their selected positions. The self-locking means comprises a taper lock and supplementary locking teeth operative on the wedge in response to loading applied thereto through the carrier element.

7 Claims, 6 Drawing Figures

ADJUSTABLE PEDESTAL FOR ELEVATED FLOORS

BACKGROUND OF THE INVENTION

The invention relates to supports for elevated floors, and in particular to adjustable pedestal supports for such floors.

PRIOR ART

Elevated floors are widely used in commercial building applications where utilities, communication lines, air ducts, and like services are extensive and frequently altered, supplemented, or repaired. In practice, it is usually difficult and prohibitively expensive to construct a subfloor which is exactly level. It has heretofore become customary to support individual panels, collectively making up the elevated floor, with pedestals separately adjustable in length so that each pedestal may be adjusted to accommodate any variations in the actual level of a local area of a subfloor from a nominal level.

A prevalent general type of pedestal design operates on the principle of a screw jack by employing an externally threaded bar or tube telescoped within an outer tube, and an internally threaded nut on or abutting an end of the outer tube. Examples of this type of pedestal are represented in U.S. Pat. Nos. 3,279,134; 3,616,584; and 3,811,237. The forming of threads on the elements of such prior art devices represents a significant portion of their cost and, consequently, limits potential cost reductions. Initial assembly of the threaded pedestal elements, further, involves manipulative steps of alignment, registration, and relative turning of various elements, each step requiring labor. Moreover, where height adjustments through a substantial range must be made during set-up in the field, manipulation of the threaded elements may be both time consuming and tedious.

SUMMARY OF THE INVENTION

The invention provides an adjustable pedestal for supporting elevated floors which employs a movable wedge element for selective height adjustment. The horizontal position of the wedge element determines the height of an upper platform of the pedestal above its base. As disclosed, the wedge vertically supports the platform and is automatically locked in a selected position in response to a downward force as applied on it by the platform. The self-locking action of the pedestal assembly is developed by confining a lower area of the wedge in a locking taper zone formed by elements of the pedestal base. The locking taper zone generates gripping forces, which are generally transverse to the plane of the wedge and which are capable of resisting forces tending to cam the wedge away from its selected position. The gripping action of the locking taper is augmented by a knurled or toothed surface integrally formed on the base, which is adapted to bite or cut into the body of the wedge and lock against slippage.

The pedestal assembly, constructed in accordance with the invention, owing to reductions in the number and complexity of parts, is significantly more economical to manufacture than are known prior art devices. Since a floor installation ordinarily requires a substantial number of pedestals, unit cost savings in manufacture is multiplied and results in a relatively low-per-square-foot installation cost.

The disclosed pedestal unit is readily assembled with few and simple manipulative steps. Adjustment in the field to suit local floor conditions is accomplished in a straightforward and time-saving manner requiring manual positioning of the wedge by simply sliding it over the base along a straight line.

These and other features and advantages of the invention will be apparent from the following disclosure of a preferred embodiment of the invention.

DESCRIPTION OF THE PREFERRED EMBODIMENT

Figure 1:
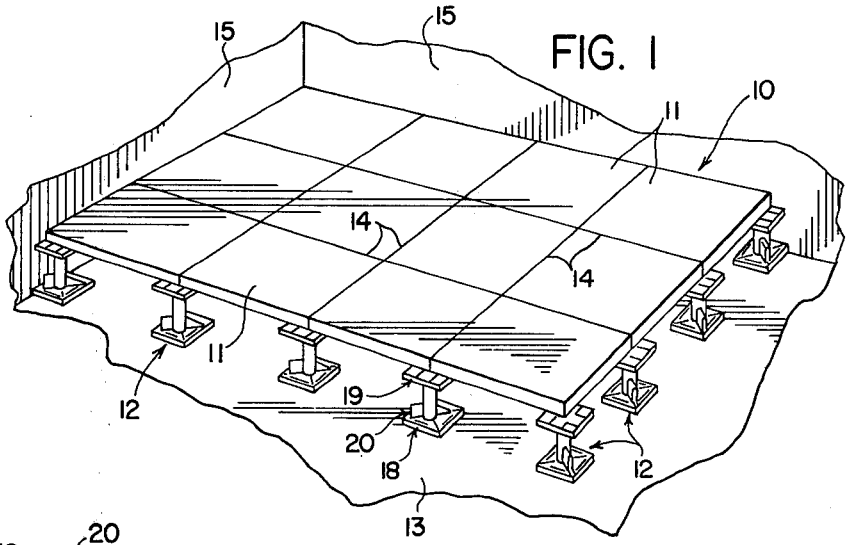
FIG. 1 is a perspective, schematic view of an area of an elevated floor employing a plurality of pedestals embodying the principles of the invention.
Figure 2:
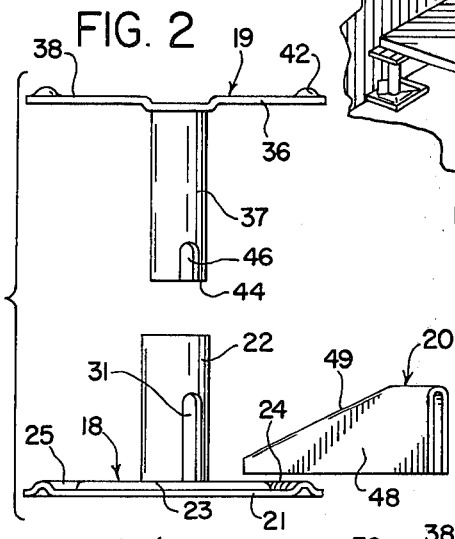
FIG. 2 is an elevational, exploded view of the pedestal of the invention.
Figure 3:
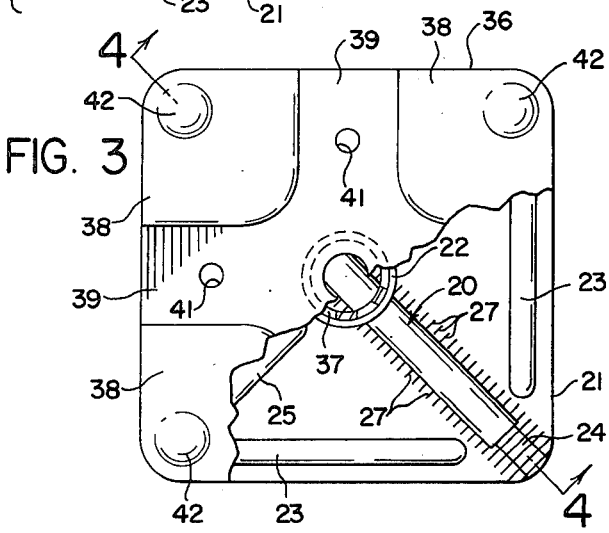
FIG. 3 is a plan view of the pedestal assembly, with portions of an upper platform thereof broken away to reveal constructional details of its base.

Referring now to the drawing, there is illustrated in FIG. 1 the corner area of an elevated floor installation 10 comprising a plurality of abutting square or rectangular panels 11 vertically supported at their corners by a plurality of pedestal assemblies 12. As shown, the pedestals 12 are arranged on a base or subfloor 13 in a rectangular matrix or gridlike pattern along joint lines 14 between the panels 11. In accordance with conventional practice, with the exception of pedestals immediately adjacent vertical walls 15, each pedestal 12 supports the corners of four panels 11.

An individual pedestal 12 comprises a base 18, a platform 19, and a wedge 20, each preferably fabricated of steel. The base 18 includes a generally square or rectangular lower plate 21 and an upstanding, round tube 22, perpendicular to the base plate. The base plate 21 is a generally planar body stamped from sheet metal stock, with embossed peripheral stiffening ribs 23 and diagonal ribs 24 and 25. The upper surface of one diagonal rib 24, which is continuous from one corner of the plate to an opposite corner, is provided with a series of discontinuities or teeth 27, like that of a knurl. The teeth or discontinuities 24, each formed crosswise of the longitudinal direction of the ribs, are provided along the full length of the rib. Each of the ribs 23 through 25, including the knurled rib 24, has an arcuate or U-shaped cross section. The rib 25 perpendicular to the knurled rib 24 is interrupted adjacent the center of the plate 21 so as not to interfere with the tube 22. The base tube 22 is projection welded or otherwise fixed to the base plate 21 substantially at its geometric center. A pair of slots 31 in the lower end of the tube 22 extend upwardly from a lower end face of the tube. The slots 31 are of substantially the same width and length and are aligned along the diagonal knurled rib 24.

The platform 19 includes a carrier plate 36 and a depending round tube 27. As shown, the carrier plate 36 includes a set of four coplanar surface areas 38. The surface areas 38 are separated and stiffened by generally flat depressions 39 embossed in the plate 36 in the form of a cross. Tapped holes 41 are provided for attachment of stringers (not shown) between pedestals, when desired, in accordance with conventional practice. Projections 42 stamped in the plate 36 are indexable with recesses in the underside of the panels 11 at their respective corners.

An upper end face 43 of the tube is projection-welded or otherwise fixed to the underside of the carrier plate 36 substantially at its geometric center. The diameter of this upper depending tube 37 is slightly smaller than the minimum inside diameter of the lower base tube 22, allowing it to telescope therein and vertically align the carrier plate 36 to the base 18. At a lower end face 44, the upper tube 37 is formed with diametrally opposite notches or slots 46 and 47 of unequal lengths corresponding to the profile of the wedge 20. The notches 46 and 47 are oriented diagonally with respect to the carrier plate 36 so that when aligned with the slots 31 of the lower tube 22, the carrier plate, as viewed from above, is in angular registration with the base plate 21.

The illustrated wedge 20 is stamped or otherwise fabricated of sheet metal stock into a body having a generally triangular profile and a U-shaped or channel-like cross section comprised of spaced, parallel sidewalls 48 and a rounded camming edge 49. The major length of the camming edge 49 is inclined in the illustrated example at an angle of approximately 20° with respect to the lower, normally horizontal sidewall edges 51. As shown, the upper tube notches 46 and 47 are rounded at their inner or base areas in a manner complementary to the camming edge 49 to distribute contact forces between these areas.

Figure 4:
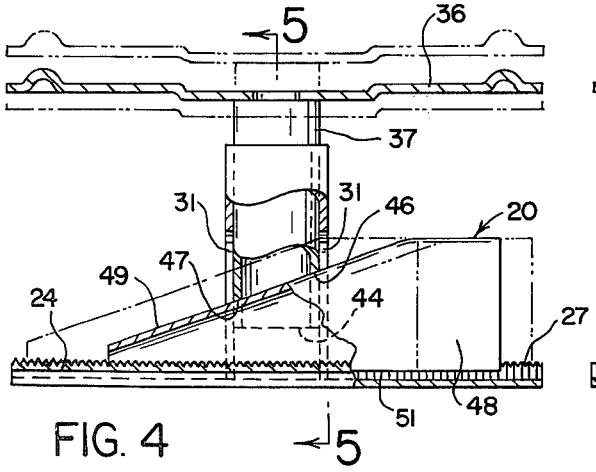
FIG. 4 is an elevational view of the pedestal in assembled condition, partially in section, and indicating variations of height adjustment in phantom.
Figure 5:
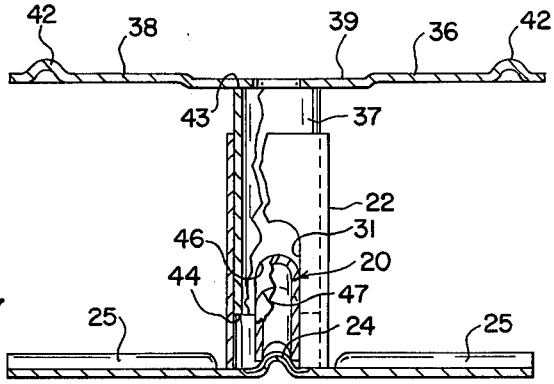
FIG. 5 is a cross sectional view of the pedestal assembly taken along the line 5—5 of FIG. 4.

As is self-evident from the above description, assembly of the pedestal 12 simply requires the upper tube 37 to be telescoped into the base tube 22, with the respective slots 31, 46, and 47 aligned with one another. The wedge 20 is first inserted into the lower base tube 22 from the side associated with the relatively longer notch 46 of the upper tube. As suggested in FIG. 4, simple horizontal positioning of the wedge 20 on the base 18 along the diagonal knurled rib 24 determines the height of the carrier plate 36 above the base plate 21. More specifically, as the wedge 20 is moved to the left a relatively higher portion of the camming edge or surface 49 is effective to support the upper platform tube 37. By adjusting the length of an individual pedestal 12 in this suggested manner, variations in the grade of local areas of the subfloor 13 are eliminated in the level of the elevated panels 11.

Figure 6:
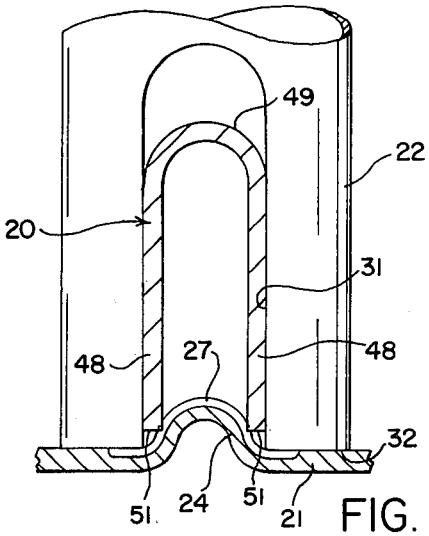
FIG. 6 is an enlarged fragmentary view of an area of contact between wedge and base elements of the pedestal.

Once the desired position of the wedge 20, and therefore the carrier plate 36, has been selected, these elements are self-locking in their position. With particular reference to FIG. 6, the lower sidewall edges 51 of the wedge 20 are confined and gripped in tapered zones defined at each wedge sidewall 48 by the lower side areas of the tube slots 31 and adjacent opposed areas of the knurled rib 24. As shown, these areas each decrease in width in a downward direction to a dimension somewhat less than the width of the sidewalls 48. A downward force imposed on the wedge 20 by the platform through the upper tube 37 causes the wedge to be frictionally locked at its selected position by contact reaction forces directed laterally against the sidewalls 48, i.e., in a direction generally perpendicular to the line of movement which the wedge 20 might otherwise take along the knurled rib 24. Frictional locking of the wedge 20 is augmented by provision of the knurl or teeth 27 along the rib 24. Preferably, these teeth 27 are relatively sharp and the hardness of the wedge edges 51 are somewhat softer than the teeth, so that the edges are adapted to be cut or otherwise permanently locally deformed by the teeth, whereby these areas are mechanically interlocked against relative movement along the rib.

While the invention has been described in connection with specific embodiments thereof, it is to be clearly understood that this is done only by way of example, and not as a limitation to the scope of the invention as set forth in the objects thereof and in the appended claims.

What is claimed is:

1. A pedestal assembly comprising a lower base, and an upper carrier element, intermediate support means extending between the base and carrier element, elements for maintaining the carrier element in generally vertical alignment with the base, said support means including adjustment means for adjustably determining the height of the carrier element above the base within a range of adjustment, said adjustment means including a wedge element movable for adjustment of the carrier element relative to the base in a direction substantially perpendicular to the direction of height adjustment, means for locking said wedge element in a selected position of adjustment, said wedge locking means being arranged to be responsive to a downward force on said carrier element, said wedge locking means including taper locking means.

2. A pedestal assembly as set forth in claim 1, wherein said taper locking means includes a toothed surface arranged to mechanically interlock said wedge element in a selected position against movement relative to said base.

3. A pedestal for supporting an elevated floor comprising a base and a platform, the base including a body having areas defining a first plane and an extension fixed to the body intermediate said areas and extending generally perpendicular to its respective plane, the platform including a bocy having surface areas at least at four points defining a second plane and an extension fixed to said platform body intermediate its associated surface areas and generally perpendicular to its respective plane, said extensions telescoping with one another with said planes being generally parallel and said platform body generally overlying said base body when said extensions are in telescoping relation, relative movement between said bodies being limited by said telescoping extensions to movement perpendicular to said planes, a wedge element disposed between said base and platform bodies, said wedge element including a first pair of diverging surface areas being arranged to cause relative displacement between said bodies in a first direction when said wedge is moved in a direction lateral to said first direction, and means for locking said wedge element in a desired position, said locking means including a second pair of diverging surface areas distinct from said first pair arranged to develop a taper locking action for locking said wedge element in said desired position.

4. A pedestal comprising a base unit including a generally planar plate and a vertically upstanding tube fixed to the center of the plate and extending generally perpendicular to the plate, said upstanding tube having one end face adjacent said plate and an opposite end face remote from said plate, a pair of vertically elongated aligned slots in opposed wall sections of said upstanding tube, said slots originating at said one end face and terminating below said other end face, a platform unit including carrier means, providing four surface areas lying in a common plane, and a vertically depending tube fixed at one end to the carrier means substantially at the geometrical center of said four surface areas, said platform and base tubes telescoping done over the other, a wedge of generally triangular profile adjustably positioned through said slots laterally with respect to the longitudinal axis of said tubes with one side of its triangular profile on said base plate and a side inclined with respect to said one side adapted to engage an area of the platform tube adjacent an end opposite its said one end, and means on the base plate for interengaging and locking the wedge in a selected position thereon, said interengaging and locking means being responsive to increased vertical loading on said platform to develop a corresponding increase in locking force, said interengaging and locking means including means developing a locking force in a direction generally perpendicular to the direction of adjustable movement of said wedge.

5. A pedestal assembly as set forth in claim 4, wherein said interengaging and locking means includes a knurled surface formed of spaced teeth and a cooperating surface extending in a direction in a plane defined by said wedge, said cooperating surface extending free of interruption for a distance substantially greater than the distance between adjacent teeth of said knurled surface, said cooperating surface being interengaged with said teeth to resist movement of said wedge from said selected position in a manner providing substantially infinite adjustment of said wedge between the limits of its adjustable movement.

6. A pedestal assembly as set forth in claim 5, wherein said knurled surface is integrally provided on said base plate.

7. A pedestal assembly comprising a base unit including a generally planar plate and a vertically upstanding tube fixed to the center of the plate and extending generally perpendicular to the plate, said upstanding tube having one end face adjacent said plate and an opposite end face remote from said plate, a pair of vertically elongated aligned slots in opposed wall sections of said upstanding tube, said slots originating at said one end face and terminating below said other end face, a platform unit including carrier means, providing four surface areas lying in a common plane, and a vertically depending tube fixed at one end to the carrier means substantially at the geometrical center of said four surface areas, said platform and base tubes telescoping one over the other, a wedge of generally triangular profile adjustably positioned through said slots laterally with respect to the longitudinal axis of said tubes with one side of its triangular profile on said base plate and a side inclined with respect to said one side adapted to engage an area of the platform tube adjacent an end opposite its said one end, and means on the base plate for interengaging and locking the wedge in a selected position thereon, said interengaging and locking means being responsive to increased vertical loading on said platform to develop a corresponding increase in locking force, said interengaging and locking means including knurled surface means developing a locking force in a direction perpendicular to the direction of adjustable movement of said wedge, said knurled surface means being integrally provided on said base plate, said base plate being rectangular and said slots of said base tube being aligned along a diagonal direction of the base plate, said base plate being formed with an embossed stiffening rib along said diagonal direction, said stiffening rib being formed with said knurled surface means, and said wedge being adapted to slide along said rib during adjustment.

* * * * *